US009120207B2

(12) United States Patent
Chang

(10) Patent No.: US 9,120,207 B2
(45) Date of Patent: Sep. 1, 2015

(54) PLIERS

(71) Applicant: Man-Chi Chang, Taichung (TW)

(72) Inventor: Man-Chi Chang, Taichung (TW)

( * ) Notice: Subject to any disclaimer, the term of this patent is extended or adjusted under 35 U.S.C. 154(b) by 295 days.

(21) Appl. No.: 13/674,968

(22) Filed: Nov. 13, 2012

(65) Prior Publication Data

US 2014/0130641 A1 May 15, 2014

(51) Int. Cl.
*B25B 7/14* (2006.01)
*B25B 7/02* (2006.01)
*B25B 7/18* (2006.01)

(52) U.S. Cl.
CPC ... *B25B 7/14* (2013.01); *B25B 7/02* (2013.01); *B25B 7/18* (2013.01)

(58) Field of Classification Search
CPC ..... B25B 7/02; B25B 7/08; B25B 7/12; B25B 7/14; B25B 7/18; B25B 5/04; B25B 5/12; B25B 5/14; B25B 5/16
USPC ..... 81/318–325, 328, 416, 418, 420; 269/6
See application file for complete search history.

(56) References Cited

U.S. PATENT DOCUMENTS

| | | | | |
|---|---|---|---|---|
| 1,093,400 | A * | 4/1914 | Gottfrid | 81/418 |
| 1,189,561 | A * | 7/1916 | Griminger | 81/320 |
| 6,212,977 | B1 * | 4/2001 | Liou | 81/323 |
| 6,877,405 | B2 * | 4/2005 | Brady et al. | 81/416 |
| 8,286,954 | B2 * | 10/2012 | Zheng | 81/318 |
| 2006/0208407 | A1 * | 9/2006 | Wang | 269/6 |

* cited by examiner

*Primary Examiner* — Hadi Shakeri

(57) ABSTRACT

A pair of pliers includes two parts pivotably connected to each other. The two parts respectively have jaws located correspondingly. A control member has one end pivotably connected to one part and an operation rod is pivotably connected to the other part and has one end movably inserted into the control member. A control lever has a first hole through which the operation rod extends. The operation rod has a first engaging portion which is engaged with a second engaging portion of the control lever. A resilient member is in contact with the control lever to engage the second engaging portion with the first engaging portion to set a desired angle between the two parts.

5 Claims, 8 Drawing Sheets

PLIERS

FIELD OF THE INVENTION

The present invention relates to a pair of pliers, and more particularly, to a pair of pliers used for pipes of vehicles.

BACKGROUND OF THE INVENTION

The conventional pliers generally comprise two parts which are pivotably connected to each other, and each part has a jaw. Each part has grooves defined in the outside thereof and a collar is mounted to the two parts and engaged with the grooves. When moving the collar to be engaged with different grooves, the width between the two jaws is adjusted so that the pliers can reach the pipes in a narrow space. However, the grooves are defined in the outside of each of the two parts, and the collar is mounted to the two parts increase the size of the tool, not only the manufacturing cost is increased, the tool cannot inserted into narrow space. The collar mounted to the outside of the two parts makes the pliers hulky and has odd outer appearance. Furthermore, the collar is an individual part which is easily lost.

The present invention intends to provide a pair of pliers which occupies less space.

SUMMARY OF THE INVENTION

The present invention relates to a pair of pliers and comprises a first part and a second part, both are made by plastic or rubber. The first part is pivotably connected to second part. The first part has a first jaw and the second part has a second jaw which is located corresponding to the first jaw. A control member has one end pivotably connected to the first part and an operation rod is pivotably connected to the second part and has one end movably inserted into the control member. A control lever has a first hole through which the operation rod extends. The operation rod has a first engaging portion which is engaged with a second engaging portion of the control lever. A resilient member is in contact with the control lever to engage the second engaging portion with the first engaging portion to set the fixed status between the operation rod and the control member. Therefore, the first and second parts are set to have a desired angle therebetween.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
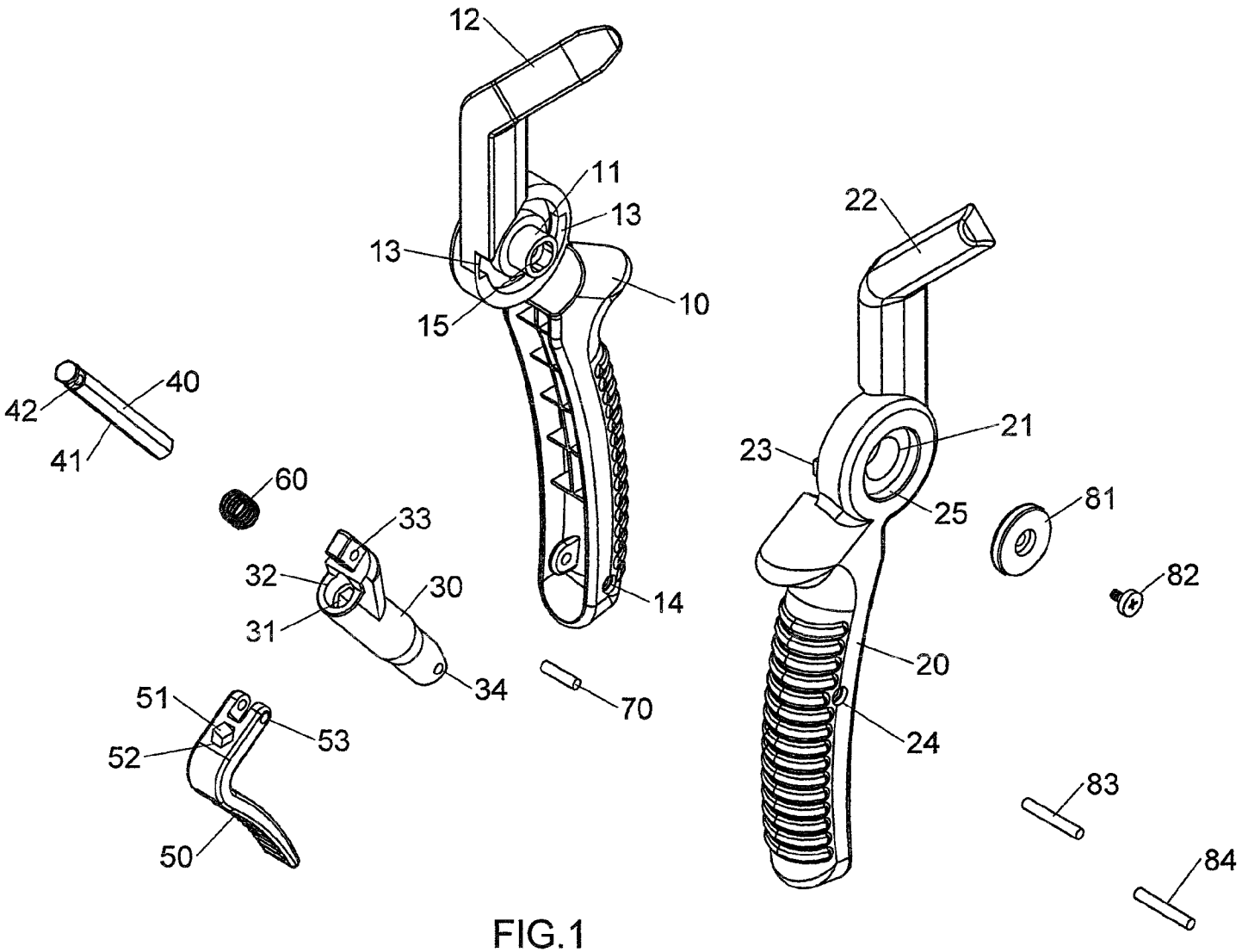
FIG. 1 is an exploded view to show the pliers of the present invention.

Referring to FIGS. 1 to 6, the pliers of the present invention is used to access the pipes in vehicles, and comprises a first part 10, a second part 20, a control member 30, an operation rod 40, a control lever 50, a resilient member 60, a first pin 70, a washer 81, a first threaded member 82, a first pivot 84 and a second pivot 83.

The first part 10 is made by plastic or rubber and has a first pivotal portion 11 at the mediate portion thereof. A first jaw 12 and a first pivotal passage 14 are respectively formed to two ends of the first part 10. The first jaw 12 extends from the first part 10 at an angle. The first pivotal portion 11 has two first restriction portions 13 and a first connection portion 15, wherein, the first restriction portions 13 are two recesses and the first connection portion 15 is a threaded hole.

Figure 2:
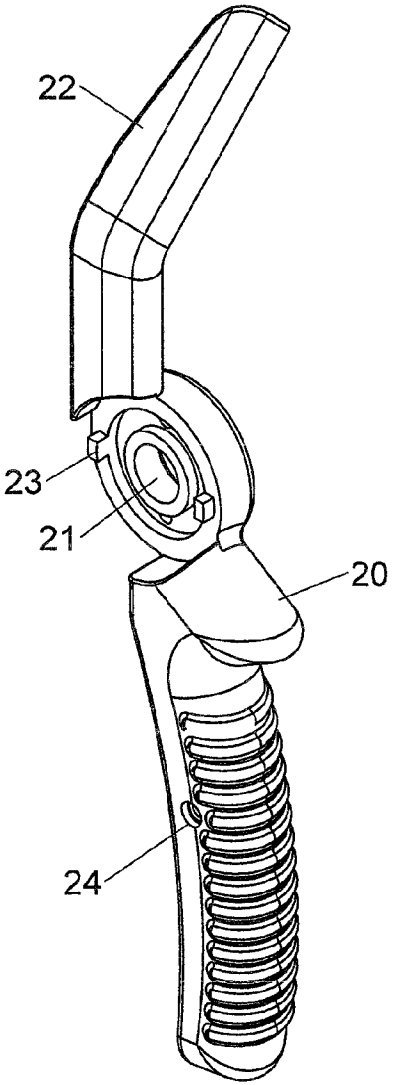
FIG. 2 is a perspective view to show the second part of the pliers of the present invention.

The second part 20 is made by plastic or rubber and has a second pivotal portion 21 which is a circular hole and pivotably connected to the first pivotal portion 11. A second jaw 22 and a second pivotal passage 24 are respectively formed to two ends of the second part 20. The first and second jaws 12, 22 are pivotably connected to each other. The second jaw 22 extends from the second part 20 at an angle. The second pivotal portion 21 has two second restriction portions 23 and each of which is a protrusion as shown in FIG. 2. The first and second restriction portions 13, 23 are mounted to each other. The first restriction portions 13 restrict the maximum open position of the first part 10. The second restriction portions 23 restrict the maximum open position of the second part 20. The second pivotal portion 21 has a circular first recess 25 defined in the center thereof.

The control member 30 has a hexagonal second recess 31 which has a space 32 defined in an opening thereof. The control member 30 has a third pivotal portion 33. A third pivotal passage 34 is defined in one end of the control member 30 and located away from the opening of the second recess 31. The third pivotal passage 34 is located in communication with and pivotably connected to the first pivotal passage 14.

The elongate operation rod 40 is movably inserted into the second recess 31 and a cross section of the operation rod 40 is matched with the second recess 31. The operation rod 40 has a first engaging portion 41 and a fourth pivotal passage 42 is defined radially through one end of the operation rod 40. The fourth pivotal passage 42 is located in communication with and pivotably connected to the second pivotal passage 24.

The control lever 50 has a first hole 51 which is located close to the mediate portion of the control lever 50. The operation rod 40 extends through the first hole 51 whose inner periphery is matched with the cross section of the operation rod 40. The first hole 51 has a second engaging portion 52. The control lever 50 has a fourth pivotal portion 53 which is located in communication with and pivotably connected to the third pivotal portion 33.

The resilient member 60 is located in the space 32 and contacts the control lever 50 to engage the second engaging portion 52 with the first engaging portion 41. The operation rod 40 is restricted by the control lever 50 to set the operation rod 40 relative to the control member 30 so that the first part 10 and the second part 20 are set at a desired angle. A pipe can be clamped between the first and second jaws 12, 22.

The first pin 70 extends through the third and fourth pivotal portions 33, 53 to pivotably connect the control lever 50 to the control member 30. The washer 81 is located in the first recess 25 of the second part 20. The first threaded member 82 extends through the washer 81 and is threadedly connected to the first connection portion 15 to pivotably connect the first part 10 to the second part 20. The second pivot 83 extends through the second and fourth pivotal passages 24, 42, and the first pivot 84 extends through the first and third pivotal passages 14, 34.

Figure 3:
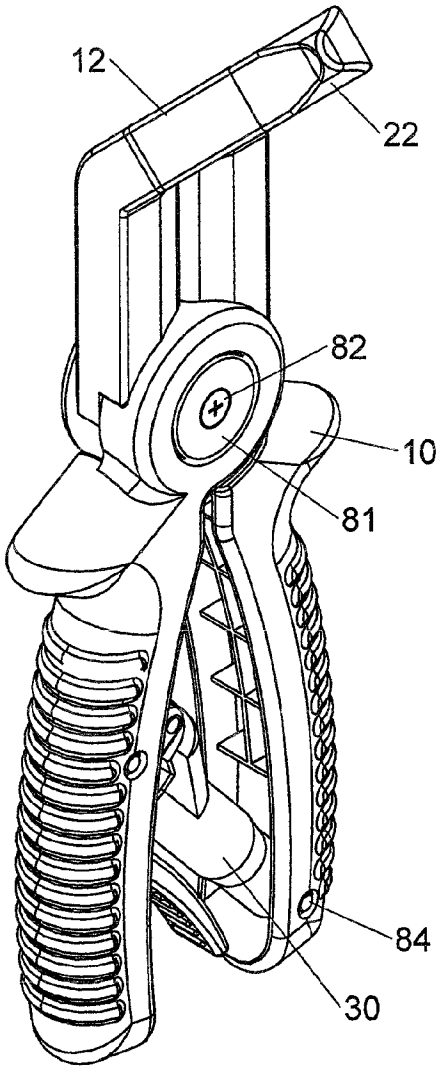
FIG. 3 is a perspective view to show the pliers of the present invention.
Figure 4:
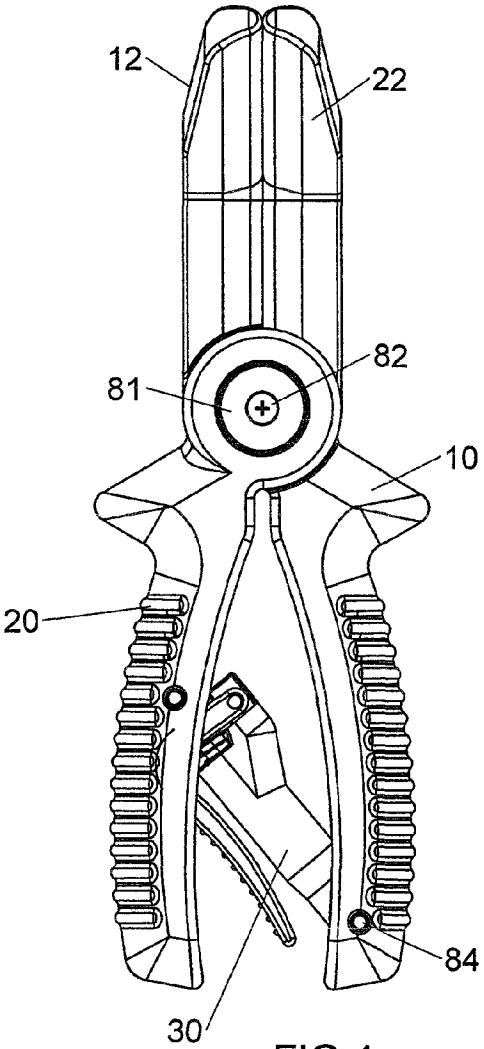
FIG. 4 is a front view of the pliers of the present invention.

As shown in FIGS. 3 and 4, the first pivotal portion 11 of the first part 10 and the second pivotal portion 21 of the second part 20 are pivotably connected to each other by the washer 81 and the first threaded member 82. The third pivotal passage 34 is pivotably connected to the first pivotal passage 14. The operation rod 40 is movably inserted into the control member 30, and the fourth and second pivotal passages 42, 24 are pivotably connected to each other. The resilient member 60 is located in the space 32. The control lever 50 is connected to the third pivotal portion 33 of the control member 30. The washer 81 is located in the first recess 25.

Figure 6:
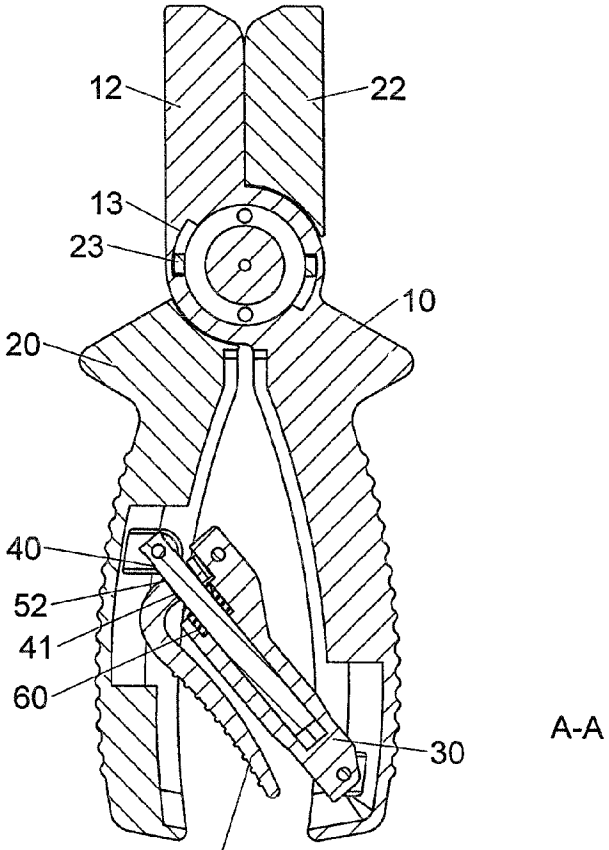
FIG. 6 is a cross sectional view, taken along line A-A in FIG. 5.
Figure 5:
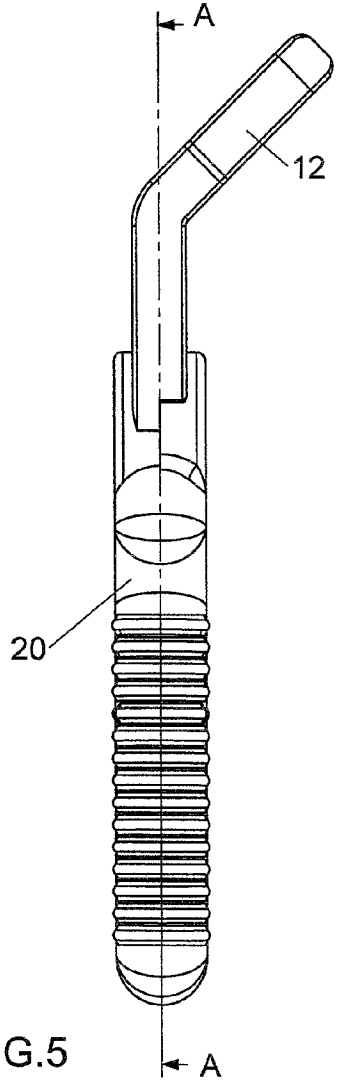
FIG. 5 is a side view of the pliers of the present invention.

As shown in FIGS. 5 and 6, the first and second parts 10, 20 are pivoted about the first and second pivotal portions 11, 21, the resilient member 60 contacts the control lever 50 so that the second engaging portion 52 of the control lever 50 is engaged with the first engaging portion 41 of the operation rod 40. The operation rod 40 is stationary relative to the control member 30. The first part 10 and the second part 20 are set at a desired angle. A pipe (not shown) can be clamped between the first and second jaws 12, 22, the pipe is clamped to be flat so as to prevent liquid in the pipe from flowing out.

Figure 7:
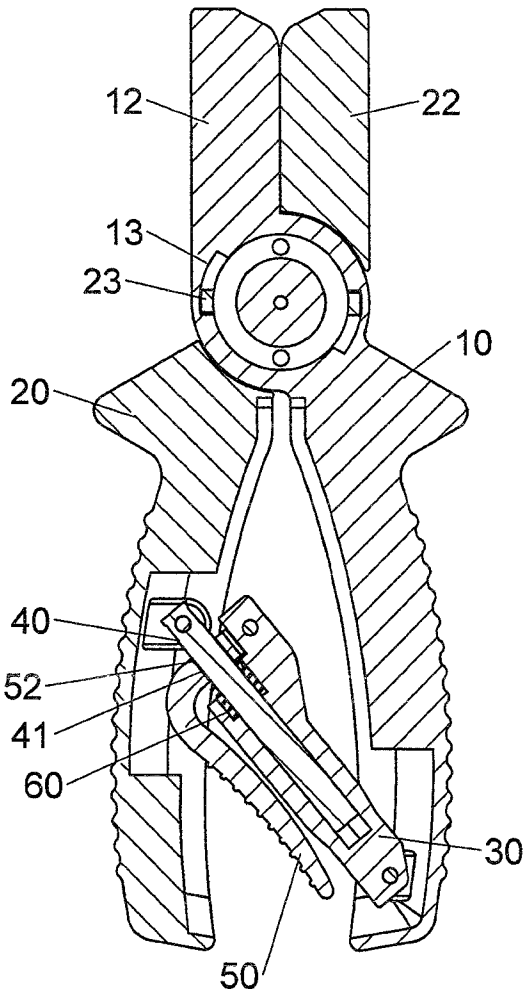
FIG. 7 shows that the first operation action of the pliers of the present invention.
Figure 8:
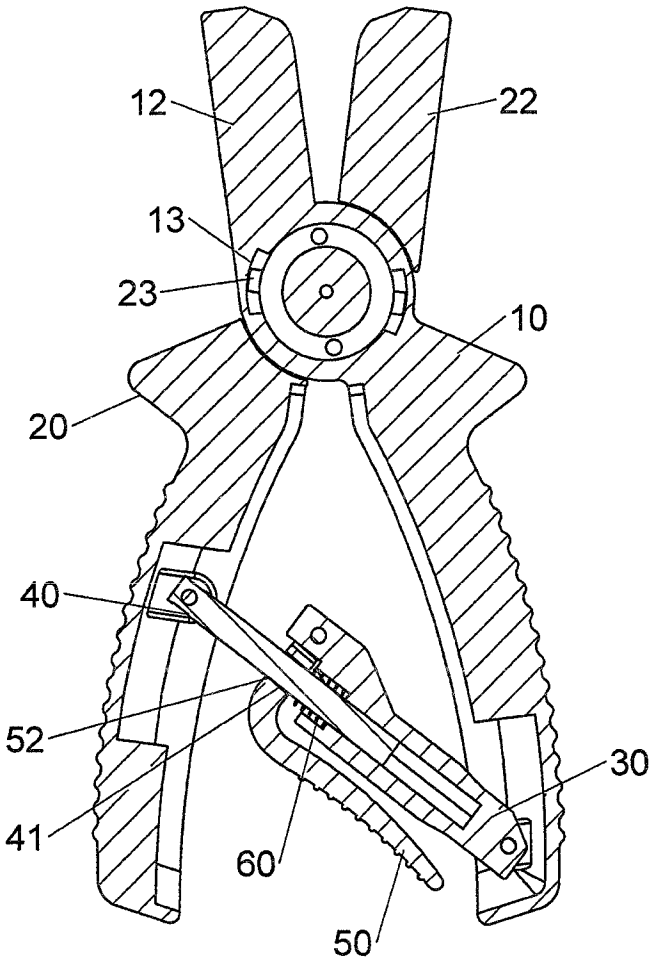
FIG. 8 shows that the second operation action of the pliers of the present invention.

As shown in FIG. 7, when the control lever 50 is pressed, the second engaging portion 52 of the control lever 50 is not engaged with the first engaging portion 41 of the operation rod 40, so that the operation rod 40 is movable relative to the control member 30. The angle between the first and the second parts 10, 20 can be adjusted. When releasing the control lever 50, the second engaging portion 52 of the control lever 50 is engaged with the first engaging portion 41 of the operation rod 40 again, so that the operation rod 40 is stationary relative to the control member 30. The angle between the first and the second parts 10, 20 is set as shown in FIG. 8.

Figure 9:
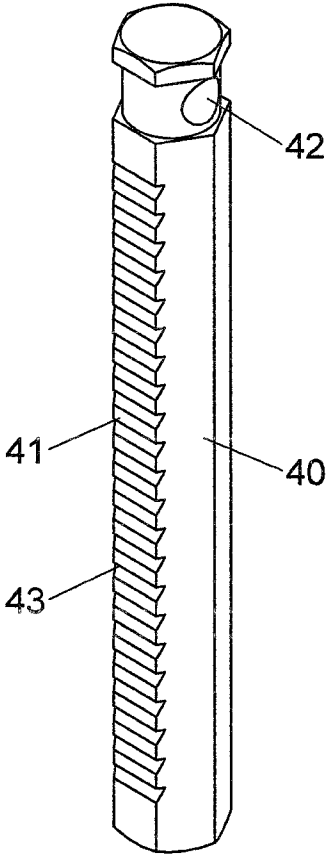
FIG. 9 is a perspective view to show the second embodiment of the operation rod of the present invention.

As shown in FIG. 9 which shows the second embodiment of the present invention, wherein the first engaging portion 41 has multiple teeth 43 and the second engaging portion 52 is engaged with one of the teeth 43 to position the operation rod 40.

The present invention has the following advantages:

1. The control member 30, the operation rod 40, the control lever 50 and the resilient member 60 are located between the first and second parts 10, 20, so that the pliers can be easily operated.
2. The first and second parts 10, 20 are individually and integrally manufactured, the pliers have better outer appearance.
3. The angle between the first and second parts 10, 20 can be conveniently adjusted by pressing the control lever 50.
4. The control member 30, the operation rod 40, the control lever 50 and the resilient member 60 are connected to the first and second parts 10, 20, so that these parts are not lost.

While we have shown and described the embodiment in accordance with the present invention, it should be clear to those skilled in the art that further embodiments may be made without departing from the scope of the present invention.

What is claimed is:

1. A pair of pliers comprising:

a first part made by plastic or rubber and having a first pivotal portion, a first jaw and a first pivotal passage respectively formed to two ends of the first part, the first jaw extending from the first part at an angle, the first pivotal portion having at least one first restriction portion and a first connection portion, the at least one first restriction portion being a recess and the first connection portion being a threaded hole;

a second part made by plastic or rubber and having a second pivotal portion which is a circular hole, a second jaw and a second pivotal passage respectively formed to two ends of the second part, the first and second jaws being pivotably connected to each other, the second jaw extending from the second part at an angle, the second jaw having at least one second restriction portion which is a protrusion, the first and second restriction portions mounted to each other, the at least one first restriction portion restricting a maximum open position of the first part, the at least one second restriction portion restricting a maximum open position of the second part, the second pivotal portion having a first recess defined in a center thereof;

a control member having a hexagonal second recess which has a space defined in an opening thereof, the control member having a third pivotal portion, a third pivotal passage defined in an end of the control member and located away from the opening of the second recess, the third pivotal passage located in communication with the first pivotal passage;

an elongate operation rod movably inserted into the hexagonal second recess and a cross section of the operation rod being hexagonal and being matched with the hexagonal second recess, the operation rod having a first engaging portion and a fourth pivotal passage defined radially through an end of the operation rod, the fourth pivotal passage located in communication with the second pivotal passage; the first engaging portion having multiple teeth;

a control lever having a hexagonal first hole and the operation rod extending through the hexagonal first hole which has an inner periphery matched with the hexagonal cross section of the operation rod, the first hole having a second engaging portion, the control lever having a fourth pivotal portion which is located in communication with the third pivotal portion; the second engaging portion being engaged with one of the teeth of the first engaging portion to position the operation rod;

a resilient member located in the space and contacting the control lever to engage the second engaging portion with the first engaging portion, the operation rod being restricted by the control lever to set the operation rod relative to the control member so that the first part and the second part are set at a desired angle;

a washer located in the first recess of the second part, and a first threaded member extending through the washer and being threadedly connected to the first connection portion to pivotably connect the first part to the second part.

2. The pliers as claimed in claim 1, wherein the first pivotal passage is a through hole and a first pivot extends through the first and third pivotal passages.

3. The pliers as claimed in claim 1, wherein the second pivotal passage is a circular passage and the located at a mediate portion of the second part, a second pivot extends through the second and fourth pivotal passages.

4. The pliers as claimed in claim 1, wherein the first hole is located close to a mediate portion of the control lever.

5. The pliers as claimed in claim 1, wherein a first pin extends through the third pivotal portion of the control member and the fourth pivotal portion of the control lever so as to pivotally connect the control lever to the control member.

* * * * *